United States Patent [19]

Springs et al.

[11] 4,395,213

[45] Jul. 26, 1983

[54] NOISE SUPPRESSING BLOCK MOLDING MACHINERY

[75] Inventors: Thomas W. Springs, Alpena; William F. Wallis, Atlanta, both of Mich.

[73] Assignee: Besser Company, Alpena, Mich.

[21] Appl. No.: 220,792

[22] Filed: Dec. 29, 1980

Related U.S. Application Data

[63] Continuation of Ser. No. 952,634, Oct. 19, 1978, abandoned, which is a continuation-in-part of Ser. No. 713,920, Aug. 12, 1976, abandoned.

[51] Int. Cl.[3] ..... B28B 1/08

[52] U.S. Cl. ..... 425/211; 425/150; 425/162; 425/421; 425/432

[58] Field of Search ..... 425/211, 413, 421, 422, 425/424, 432, 150, 162

[56] References Cited

U.S. PATENT DOCUMENTS

| | | | |
|---|---|---|---|
| 2,341,012 | 2/1944 | Billman et al. | 425/432 X |
| 2,407,168 | 9/1946 | Lindkvist | 425/421 X |
| 2,875,499 | 3/1959 | Ross | 425/413 X |
| 2,888,731 | 6/1959 | McElroy et al. | 425/421 |
| 3,153,834 | 10/1964 | Boyer et al. | 425/421 X |
| 3,158,089 | 11/1964 | Fillol | 425/389 X |

FOREIGN PATENT DOCUMENTS

| | | | |
|---|---|---|---|
| 1160066 | 7/1958 | France | 425/421 |

*Primary Examiner*—Jan H. Silbaugh
*Attorney, Agent, or Firm*—Learman & McCulloch

[57] ABSTRACT

Machinery and methods for making concrete blocks includes an open top and open bottom mold supported on a machine's frame when the mold is at rest. A pallet support beneath the mold is movable upwardly by means of a pallet lifter frame to clamp a pallet against the bottom of the mold. Upward movement of the pallet support is accompanied by upward movement of the mold off the frame to enable vibration of the mold without the generation of noise between the mold and the frame. A stripper head is supported above the mold for entry into the latter during vibration of the mold to assist in compacting moldable material within the mold. The stripper head is carried by a movable frame the movements of which are controlled by a cam and an interconnecting linkage, and the stripper head is vertically movable relative to the frame. Inflatable/deflatable cushions or absorbers are interposed between the stripper head and the stripper head frame to minimize noise. Additional inflatable/deflatable absorbers are interposed between the stripper head and the stripper head frame and which act in conjunction with the first mentioned absorbers to effect movement of the stripper head relative to the stripper frame and to the mold in advance of block stripping operations to avoid crushing the molded blocks as they are stripped from the mold.

1 Claim, 9 Drawing Figures

NOISE SUPPRESSING BLOCK MOLDING MACHINERY

RELATED APPLICATION

This application is a continuation of application Ser. No. 952,634, filed Oct. 19, 1978, now abandoned which is a continuation-in-part of application Ser. No. 713,920, filed Aug. 12, 1976 now abandoned.

BACKGROUND OF THE INVENTION

It is conventional practice in the molding of concrete blocks and the like to close the open bottom of a block mold by means of a pallet, introduce moldable material into the mold through its top, lower a stripper head into the mold, vibrate the mold to compact the material as the stripper head moves downwardly until the height of the molded block has been established, and then move the pallet support and the stripper head downwardly in unison to strip the molded block from the mold. The palletized block then is transferred from the pallet support to a conveyor or the like for delivery elsewhere, and the process then repeated for the production of additional blocks.

The operation of block molding machinery has been accompanied in the past by the generation of considerable noise. The generation of noise in the molding of blocks has been reduced substantially by fairly recent developments of the kind disclosed in the above mentioned application Ser. No. 713,920. Such apparatus achieves noise reduction by elevating the mold off the machine frame and clamping the pallet against the mold during its vibration by cushioned clamping means. It thus is possible to vibrate the mold and the pallet in unison without relative movement therebetween, thereby minimizing considerably the generation of noise.

To assure adequate control over the height of molded blocks it is preferred that the stripper head move into engagement with the moldable material during the vibration of the mold. As the material is compacted, the stripper head must move downwardly if it is to remain in contact with the material. This necessitates downward driving movement of the stripper head by suitable means, such as a cam controlled linkage. Since the mold vibrates, however, the linkage must absorb or compensate for the vibration of the stripper head caused by its engagement with the material in the mold. Such absorption or compensation results in the generation of noise.

A principal object of this invention is to provide concrete block making machinery and methods wherein the noise reduction associated with machinery of the kind disclosed in the aforementioned application can be retained and, in addition, substantial reduction of noise generated by the stripper head and its associated parts is achieved.

SUMMARY OF THE INVENTION

Block making machinery constructed in accordance with a preferred embodiment of the invention incorporates noise suppression apparatus associated with a vibratable mold and pallet support mechanism substantially as disclosed in the aforementioned application. In addition, apparatus constructed in accordance with the invention includes a stripper head that is vertically movable with and relatively to its supporting frame. Acting between the stripper head and its supporting frame are inflatable and deflatable resilient absorbers which, when inflated, enable cushioned movement between the stripper head and its supporting frame during vibration of the mold. Such sound absorbers are deflatable to avoid the imposition of premature downward force by the stripper head on the molded material during stripping operations, thereby avoiding crushing of the molded block during its movement out of the mold. Also provided are additional inflatable/deflatable cushions which act between the stripper head and its supporting frame to ensure the avoidance of the premature application of compressive force on the molded blocks during their movement out of the mold.

THE DRAWINGS

Apparatus constructed in accordance with a preferred embodiment of the invention is disclosed in the accompanying drawings, in which.

THE PREFERRED EMBODIMENT

Figure 2:
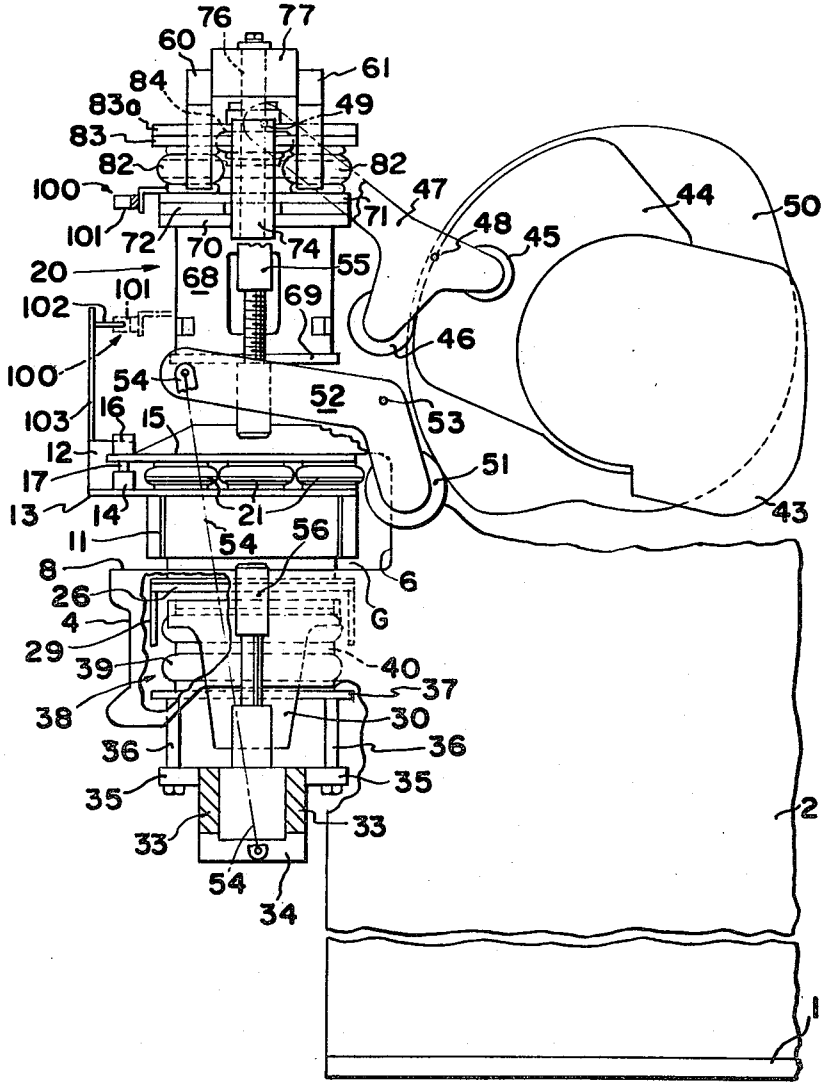
FIG. 2 is a fragmentary, side elevational view of the apparatus illustrated in FIG. 1.

A block making machine fitted with apparatus according to the invention has a base 1 provided with an upstanding frame, including spaced apart frame members 2 and 3 having between their upper and lower ends forwardly projecting arms 4 and 5, respectively. The frame members are notched to provide throats 6 having flat, horizontal support surfaces 8. Spanning the throats and supported upon the surfaces 8 when at rest is a mold frame 10 on which is supported a mold member 11 having an open top and an open bottom. The interior of the mold is shaped to correspond to the block (or plurality of blocks) of the kind to be molded. A shroud 12 is carried by the frame 10 and surrounds the open top of the mold 11 as is conventional.

At opposite ends of the mold frame 10 are secured a pair of fore and aft extending lower plates 13. At the forward end of each plate is fixed a bushing 14. Parallel to, but spaced above each plate 13 is a corresponding upper plate 15 at the forward end of each of which is fixed a block 16 from which depends a guide pin 17 which snugly, but slidably, is accommodated in the companion bushing 14.

The upper plates 15 are secured to the lower ends of vertical supports 18 which constitute parts of the machine frame and form slidable guides for a stripper frame 19 which is vertically reciprocable by means yet to be described. The frame 19 supports a stripper head 20 which is of such size and shape as to fit snugly, but slidably, within the mold 11. The manner in which the stripper head 20 is supported by the stripper head frame 19 will be described in more detail hereinafter.

The mold frame 10 is supported on the surfaces 8 of the throats 6 when the mold is at rest, but the mold frame is capable of vertical movements and is guided in such movements by the guide pins 17. Upward movement of the mold frame off the surfaces 8 is opposed by yieldably compressible, gas filled, expansible and contractible rubbery bags or cushions 21 interposed between the lower and upper plates 14 and 15, respectively. The extent to which the mold frame 10 can move upwardly relatively to the throat surfaces 8 is determined by the compressibility of the bags and by the upward force applied to the frame 10. For purposes of the invention, it is sufficient if the mold frame 10 is capable of movement off the throat surfaces 8 a distance to provide a gap G (see FIG. 2) of about ¾ inch between the surfaces 8 and the bottom of the frame 10.

As is conventional the mold frame 10 is fitted with motor driven vibrators 23 for the purpose of vibrating the frame 10 and mold 11. The vibrating movement of the mold frame includes a vertical component the amplitude of which is less than the height of the gap G so as to avoid engagement between the frame 10 and the throat surfaces 8 during vibration of the mold.

The molding machine also includes a pallet support 25 comprising an upper plate 26 fitted with rubbery pads 27 atop which a metal pallet 28 removably may be supported to form a temporary bottom for the mold 11. The upper plate 26 has a depending skirt 29 within which is accommodated the upper ends of a pair of downwardly tapering support arms 30. The upper ends of the arms are fixed to the plate 26.

A pallet support lifter frame 32 is provided and comprises a pair of spaced apart members 33 joined at their ends by cross members 34. Each member 33 has fixed thereto a bar 35 to which is anchored the lower ends of a pair of struts 36, the upper ends of which are fixed to a horizontal pressure plate 37. The construction is such that the lifter frame 32 and the pressure plate 37 are vertically movable as a unit.

Fitted at the top of the pressure plate 37 is a yieldably compressible force applying means 38 comprising a gas filled, expansible and contractible bag 39 encircled at its center by a ring 40. The bag bears at its upper end against the bottom of the pallet support plate 26. Since the bag is compressible, it forms a lost motion coupling between the lifter frame 32 and the pallet support 25 which enables relative vertical movement therebetween.

The extent of downward movement of the pressure plate 37 relative to the pallet support 25 may be regulated by means of a plurality of adjustable positioning screws, two of which are shown at 41 (FIG. 1), which are threadedly mounted in lugs 42 carried by the support arms 30. The screws 41 are received in recesses **37*a* in plate 37 when the machine is at rest and are adjustable for the purpose of ensuring a parallel relation between the plane of the mold 11 and the plane of the pallet support plate 26** when the gap G has been eliminated.

The vertical movements of the stripper frame 19 and the pallet lifter frame 32 are effected by cam controlled conventional drive means illustrated diagrammatically in FIG. 2. The drive means for the stripper frame 19 comprises a pair of motor driven cams 43 and 44 which are engageable with and disengageable from a pair of followers 45 and 46, respectively, journaled at one end of a bell crank 47 that is pivoted as at 48 to the machine frame. The opposite end of the crank is pivotally connected by a linkage, diagrammatically indicated at 49, to the stripper frame 19 to effect vertical movements of the latter according to the contour of the cams. For purposes of clarity of illustration, the cams 43 and 44 are depicted in FIG. 2 in positions which do not necessarily correspond to the positions they occupy when the stripper frame 19 and the lifter frame 32 are in the positions shown in FIGS. 1 and 2. As stated earlier, however, the cams and their linkages are conventional and are well known in the art.

The drive means for the pallet lifter frame 32 comprises a motor driven cam 50 in engagement with a follower 51 journaled at one end of a bell crank 52 that is pivoted to the machine frame at 53. The opposite end of the crank 52 is connected by linkage 54 to the lifter frame cross members 34. The contours of the cams are so related to one another as to effect precise conjoint and relative movement of the stripper frame 19 and the lifter frame 32 for a purpose presently to be explained.

As is conventional the stripper frame 19 and the lifter frame 32 are provided with confronting pairs of vertically aligned adjustable stop members 55 and 56 operable to halt the relative movement of such frames toward one another during the stripping step. Members 55 are rigidly fixed to beam 60 and members 56 are rigidly fixed to beam 33.

The stripper head frame 19 comprises a pair of spaced apart, parallel frame members 60 and 61 joined by cross members 62. Each of the frame members 60 and 61 is provided with a pair of spaced apart notches 63 and 64, thereby providing each of the frame members with a centrally located lip portion 65. Each lip 65 is notched as at 66 to accommodate a plate 67 that is bolted or otherwise suitably secured to each of the frame members 60 and 61. The plate 67 is of such length as to project fore and aft of the frame members. Fixed atop the plate 67 is a manifold **67*a***, the purpose of which will be explained subsequently.

The stripper head 20 comprises a plurality of conventional stripper legs 68, each of which terminates at one end in a flat foot 69. The opposite end of each of the legs 68 is fixed in any suitable manner to a head plate 70. The plate 70 is below and parallel to a second plate 71 and is spaced from the latter by spacers 72. The plates 70 and 71 and the spacers 72 are fixed to one another by bolts 73 or the like.

At its opposite ends the plate 71 is fixed to a pair of tubular bushings 74 the lower ends of which extend through openings 75 in the head plate 70. Slidably accommodated in each bushing is a guide pin 76 that is fixed at its upper end in a block 77 secured between the frame members 60 and 61. The plates 70 and 71, together with the stripper head 20, are vertically movable relatively to the stripper frame members 60 and 61.

The plate 71 also has fixed thereto two pairs of upstanding posts 78 and 79 atop which seats an upper plate 80 and which is fixed to the posts by bolts 81. The pairs of posts straddle the plate 67 and the upper plate 80 spans and overlies the plate 67.

First cushioning or vibration absorbing means is interposed between the stripper head frame 19 and the stripper head 20 and comprises a plurality, such as four, inflatable/deflatable rubbery bags 82, each of which is interposed between the plate 71 and a seat member 83 accommodated in the associated notches 63 and 64 and bolted or otherwise secured to base members **83*a* fixed to the frame members 60 and 61. Inflation of the bags 82 effects expansion or vertical elongation of the bags and consequently an increase in the vertical spacing between the plate 71 and the frame members 60 and 61**.

A second cushioning or absorbing means arranged in opposition to the first is interposed between the stripper head frame 19 and the stripper head 20 and comprises a plurality, such as two, inflatable/deflatable rubbery bags 84 interposed between the manifold plate 67*a* and the plate 80. Inflation of the bags 84 effects expansion or vertical elongation thereof, accompanied by upward movement of the stripper head 20 relative to the frame 19 and consequent reduction in the vertical spacing between the plate 71 and the stripper frame members 60 and 61.

Inflation and deflation of the first and second absorbing means are effected by pressure fluid means yet to be described, but it is convenient at this point to state that the plate 71 has fluid passages therein which communicate with each of the bags and the manifold plate 67*a* has fluid passages therein which communicate with each of the bags 84.

Means for inflating and deflating the bags 82 and 84 comprises a known four-way valve 86 (such as Ross valve No. 7276B3301) connected by a line 87 to a source (not shown) of pressure fluid, preferably compressed air, via a pressure regulator 88 and a filter 89. The valve 86 is connected to a line 90 that communicates with four branches 91 leading to four two-way valves 92 (such as Ross valve No. 2751A3001). Each of the valves 92 communicates via a passage 93 in the plate 71 with one of the bags 82. Each of the valves 92 also has an exhaust line 94 which communicates with a line 95 leading to and through the valve 86.

Extending from the valve 86 is a line 96 that communicates with passages 97 and 98 in the plate 67*a* which, in turn, communicate with the bags 84. The passage 97 also communicates with an exhaust line 99 that extends to and through the valve 86.

In one position of the valve 86 all four of the bags 82 communicate with the pressure fluid source via the lines 90 and 91, the passages 93, and the valves 92 so as to effect inflation of the bags. In a second position of the valve 86 the bags 82 communicate with atmosphere via the passages 93, the valves 92, and the lines 94 and 95 so as to effect deflation of the bags 82. In the second position of the valve 86 the bags 84 communicate with the pressure fluid source via the line 96 and the passages 97 and 98 so as to effect inflation of the bags. In the one position of the valve 86 the bags 84 communicate with atmosphere via the passages 97 and 98 and the line 99 so as to effect deflation of the bags.

Figure 9:
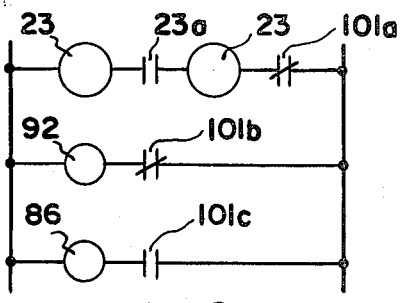
FIG. 9 depicts a schematic electrical control system.

The positions of the valves 86 and 92 and controlled by a known proximity switch 100 (FIGS. 1 and 2) such as switch No. SJ-15-WS manufactured by R. B. Denison, Inc., Bedford, Ohio. The switch comprises a sensor 101 mounted on and projecting forwardly of the plate 71 and having a slot therein for the reception of an actuator 102 carried by a support 103 that is fixed to and extends upwardly from the shroud 12. The proximity switch is connected by electrical lines (FIG. 9) to vibrator motors 23 and to the valves 86 and 92 in such manner that, upon movement of the actuator 102 into and out of the sensor 101, the motors 23 are controlled and valves 86 and 92 move from one position to the other.

OPERATION

Figure 1:
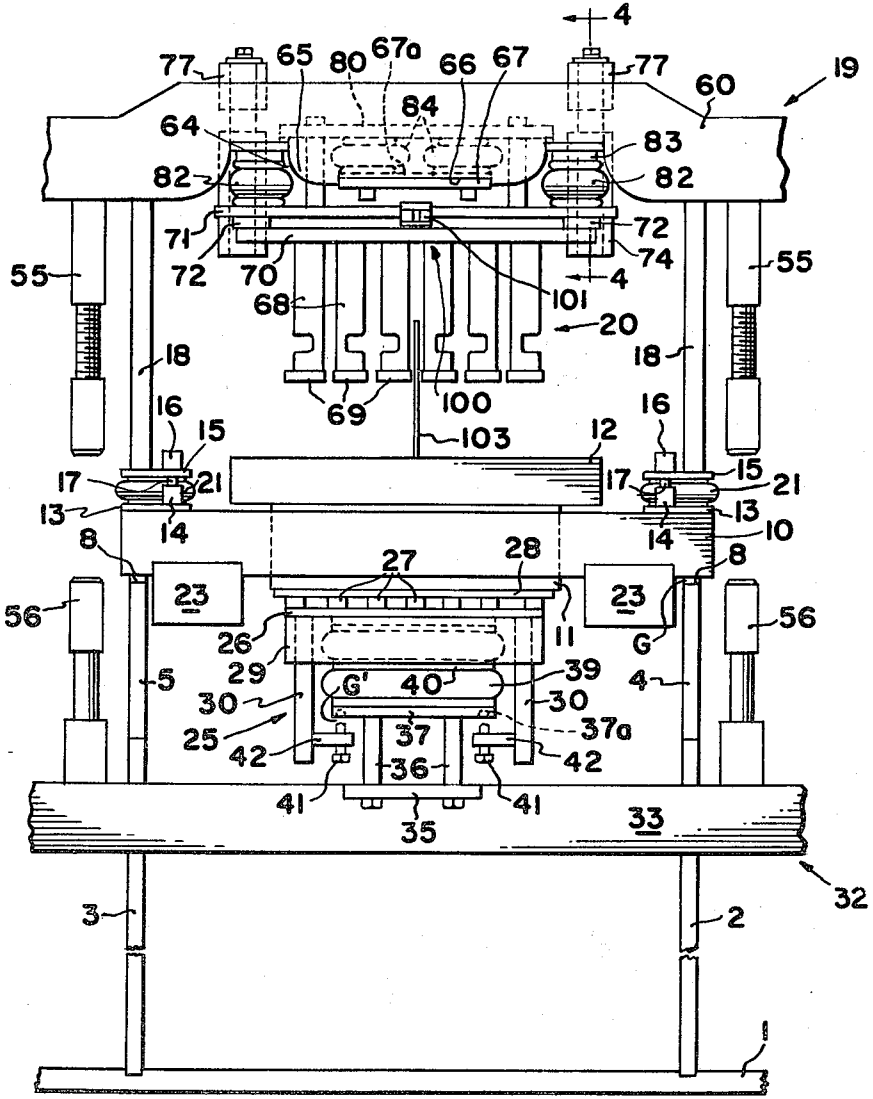
FIG. 1 is a fragmentary, front elevational view of block molding machinery constructed in accordance with the invention, with certain parts being broken away for clarity of illustration.

When the machine is conditioned for the molding of a block, the stripper frame 19 will be in an elevated position, as shown in FIGS. 1 and 2, to permit moldable material to be introduced to the mold 11 between the latter and the stripper head 20. A pallet 28 will be supported on the pallet support 25 and will engage the bottom of the mold 11 to form a removable bottom for the latter. Before filling of the mold the lifter frame 32 will be elevated, thereby elevating the pressure plate 37 to a level above that of the positioning screws 41 to form a gap G′ (FIG. 1).

Movement of the pressure plate 37 off the screws 41 causes an upward force to be applied by the bag 39 to the pallet support 25 so as to cause the plate 26 to clamp the pallet 28 tightly against the mold 11 and lift the mold frame 10 upwardly off the throat surfaces 8 to form the gap G. The upward movement of the mold frame 10 causes the lower plates 13 to move upwardly relative to the fixed plates 15, thereby effecting compression of the gas filled bags 21. The bags 21 thus apply a compressible force on the mold frame 10 in opposition to the force applied by the bag 39, and the gas content of the respective bags is so selected that the opposing forces are equal, whereby the mold frame 10 is yieldably suspended between the throat surfaces 8 and the upper plates 15.

The upward movement of the pallet support 25 causes corresponding movement of the plates 30 and of the positioning screws 41, but such movement is insufficient to effect reengagement of the screws with the pressure plate 37 because of the opposition force applied on the pallet support 25 via the members 21. The gap G′ thus will be maintained between the pressure plate 37 and the screws 41, and the height of such gap will be greater than the amplitude of vertical movement of the mold during its vibration.

Figure 7:
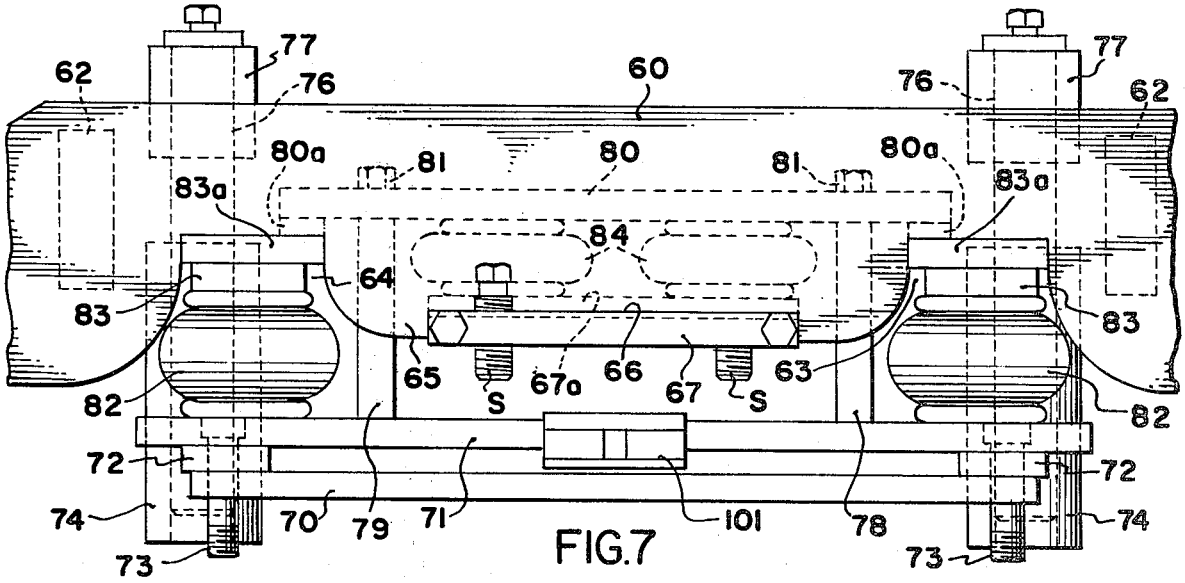
FIG. 7 is a front elevational view of the structure shown in FIG. 6.

Before the moldable material is introduced to the mold but after the mold and pallet are clamped together in a suspended state above the throat surfaces 8, the vibrators 23 are operated by closing a machine sequencing relay contact 23*a* (FIG. 9) to vibrate the mold frame, thereby effecting even distribution and compaction of the moldable material throughout the mold. During the vibration of the mold frame, the stripper frame 19 is lowered by its drive means so as to cause the stripper head 20 to enter the mold 11 and effect engagement between the feet 69 and the material in the mold. Prior to such movement of the stripper frame 19, the bags 82 are inflated, as shown in FIGS. 1, 2, and 7, and the bags 84 are deflated, thereby disabling the latter from applying force between the head and the frame 19. The stripper head 20 thus is enabled to move relatively to the frame 19 in a direction toward the mold and occupies its lowest position relative to the stripper frame members 60 and 61. This position is determined by engagement of the ends of the plate 80 with the base members 83*a* against which the upper ends of the bags 82 bear via their seats 83. Preferably, rubbery or other suitable cushioning material 80*a* is interposed between the confronting surfaces of the plate 80 and the members 83*a* for noise reduction purposes.

Once the feet 69 of the stripper head 20 engage the material in the mold, downward movement of the stripper head 20 is limited to the rate at which the material in the mold is compacted. However, the stripper head frame 19 continues to move downwardly under the influence of its drive mechanism. In conventional constructions the continuous downward movement of the stripper head frame while the stripper head engages material in the mold results in the generation of considerable noise inasmuch as the linkage of the drive mechanism is subjected to substantial buffeting due to vibration imparted thereto via the stripper head. In the present construction, however, the bags 82 are sufficiently compressible to absorb the vibration to which the stripper head 20 is subjected, thereby avoiding the transmission of such vibration to the driving linkage of the stripper head frame 19. As a consequence, the generation of noise is minimized considerably.

As the stripper head frame 19 continues its downward movement, the stripper head 20 also will move downwardly into the mold 11. Eventually the stripper head 20 will move downwardly into the mold 11 a distance sufficient to enable the actuator 102 to enter the sensor 101 of the proximity switch 100. The sensor will generate a signal that is transmitted to the valve 86 and 92 via a relay contact 101*b* to shift the valve and effect deflation of the bags 82. At the same time the sensor 100 halts vibration of the mold and inflates bags 84 via a relay contact 101*a*. Deflation of the bags 82 is effected via a relay contact 101*c*. The deflation of the bags 82 disables them from applying force between the frame 19 and the head 20, and inflation of the bags 84 enables them to apply force between the members 19 and 20 and effect upward movement of the head 20 relative to the frame 19. The stripper head 20 thus can remain substantially stationary while the stripper head frame 19 continues its downward movement until such time as the stop pins 55 and 56 engage one another. Typically the bags 82 are deflated when the stops 55, 56 are about ¾ inch apart. By the time the stops 55, 56 engage one another the inflated bags 84 relieve the load on the "green" concrete block by partially or wholly supporting the weight of the stripper head (see FIG. 3). Following engagement of stops 55, 56 the molded block is stripped from the mold 11 by effecting simultaneous downward movement of the stripper head 20 and the pallet support 25 a distance sufficient to enable the molded block to be pushed through the mold to a level below that of the bottom of the mold. In the stripping operation, however, it is important that the green block emerging from the mold not be subjected to compressive force which would cause the emerging block to crumble. This desired result is achieved in the present construction in two ways.

The mold frame 10 may be lowered onto the throat surfaces 8 to eliminate the gap G and simultaneously eliminate the gap G′ between the pressure plate 37 and the screws 41. Closing of the gaps G and G′ is effected by the driving mechanisms for the stripper frame 19 and the pallet lifter frame 32. The cams 43 and 44 for controlling the movements of the stripper frame 19 are so contoured that the stripper frame is lowered relatively to the lifter frame 32 to a level in which the cooperable stops 55 and 56 engage one another, as stated previously. During such movement of the stripper frame the pallet lifter frame 32 remains stationary. The stripper frame driving cam 43 and the lifter frame driving cam 50 are so contoured, however, that, following engagement of the cooperable stop members 55 and 56, the stripper frame 19 and the lifter frame 32 move downwardly simultaneously to free the molded block in the mold. The cams 43 and 50 drive the stripper frame 19 and the lifter frame 32 downwardly and at the same speed, thereby maintaining the relative positions of the stripper frame 19 and the lifter frame 32, but effecting lowering of the mold member 10 into seating engagement on the throat surfaces 8 so as to eliminate the gap G. Downward movement of the lifter frame 32 will cause the pressure plate 37 to seat on the positioning screws 41, thereby eliminating the gap G′, also.

Following engagement of the pressure plate 37 with the positioning screws 41, further rotation of the cam 50 effects further downward movement of the lifter frame 32 and such movement of the lifter frame is transmitted via the pressure plate 37 and the screws 41 so as to effect simultaneous downward movement of the pallet support 25. Thereafter, the stripper frame 19 and the lifter frame 32 continue to move downwardly at the same rate of speed so as to enable the molded block to be pushed downwardly through the mold 11 and ejected from the latter. During the ejection of the molded block from the mold 11, the bag 39 is maintained in a less compressed state, and the engagement between the pressure plate 37 and the screws 41 prevents upward movement of the pallet support 25 relative to the lifter frame. As a consequence, the pallet support 25 does not exert any force on the block being stripped from the mold 11.

Figure 3:
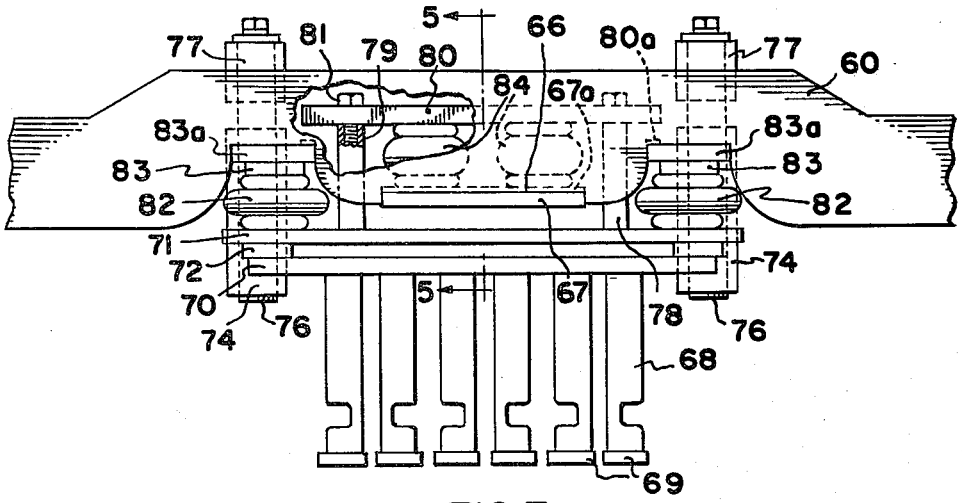
FIG. 3 is a fragmentary elevational view of the stripper head and its supporting frame.
Figure 4:
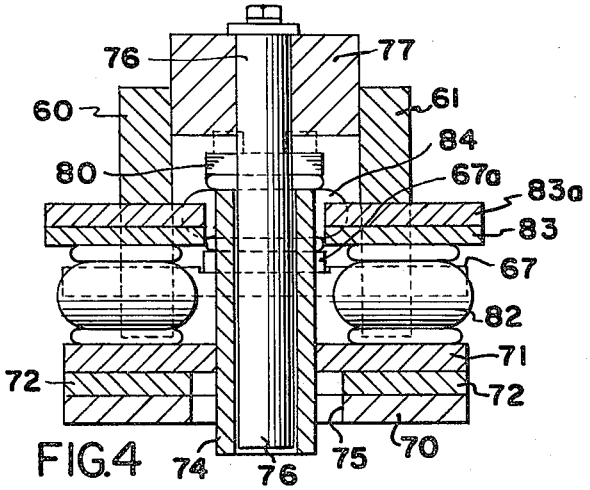
FIG. 4 is a sectional view taken on the line 4—4 of FIG. 1.
Figure 5:
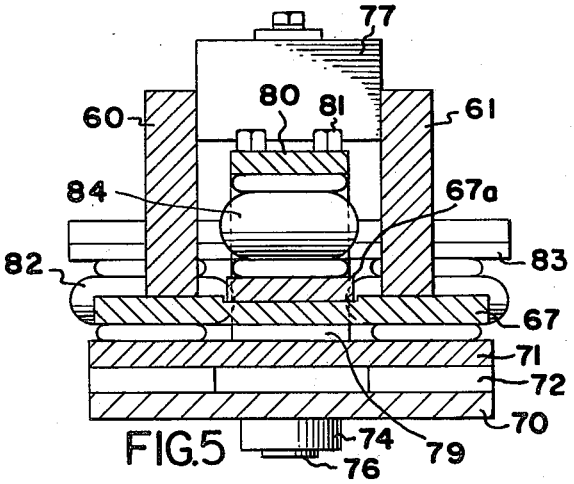
FIG. 5 is a sectional view taken on the line 5—5 of FIG. 3, but with the parts in adjusted positions.
Figure 8:
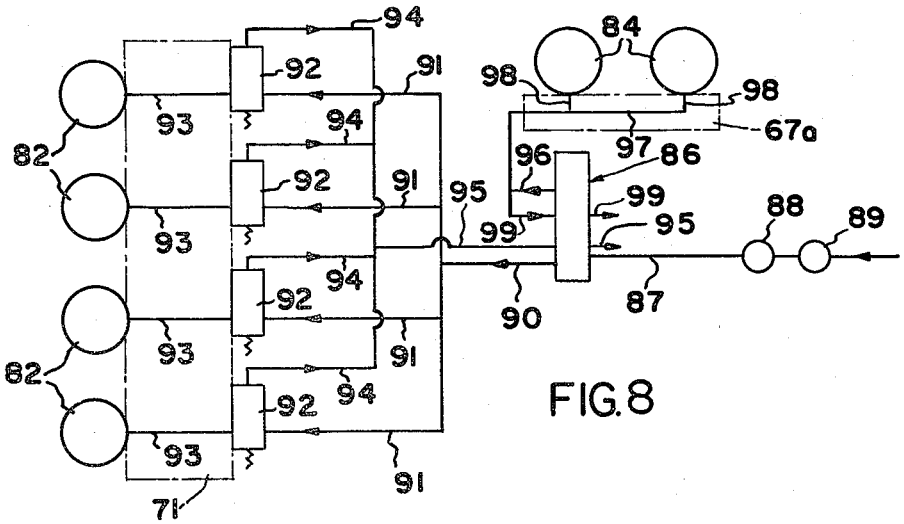
FIG. 8 is a schematic view of pneumatic control apparatus.
Figure 6:
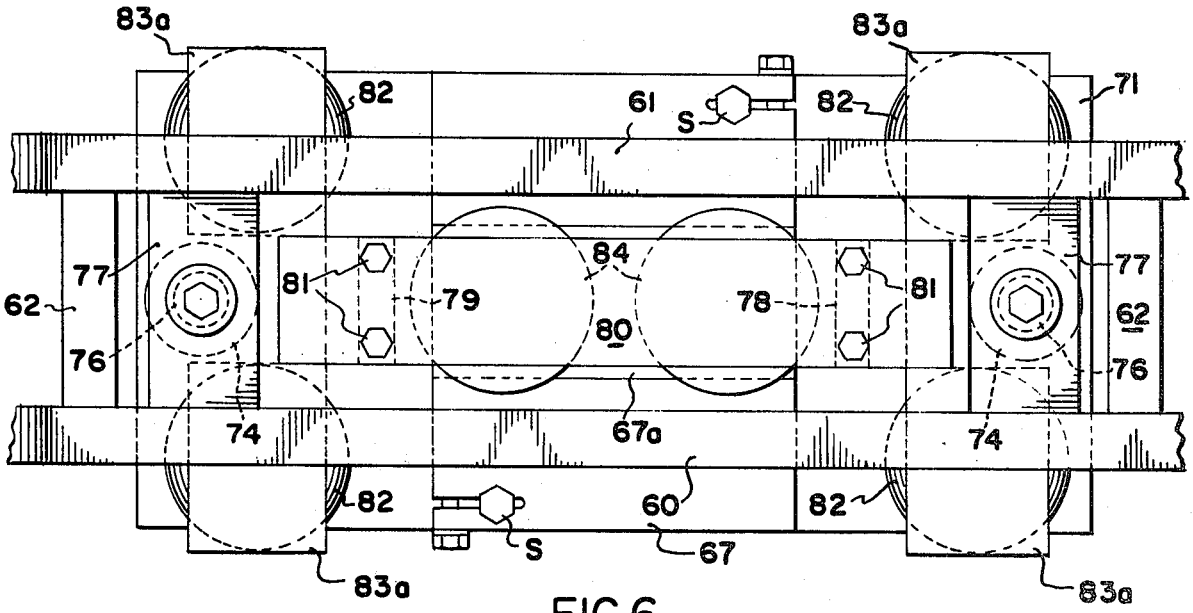
FIG. 6 is a top plan view, on an enlarged scale, of the apparatus illustrated in FIG. 3.

In addition, inflation of the bags 84 following deflation of the bags 82 will cause the bags 84 to expand, as shown in FIGS. 3 and 5, and exert a force between the plates 67 and 80 to cause the stripper head 20 to move upwardly relative to the stripper head frame members 60 and 61. Such relative movement will cause the plate 80 to occupy a position spaced above the members 83*a*, as is best shown in FIG. 3, and will create a gap between the stripper head feet 69 and the material in the mold 11. Upward movement of the head 20 relative to the frame members 60 and 61 is limited by adjustable stops S carried by the plate 67 and engageable with the plate 71. Following engagement of the stop members 55 and 56 and elimination of the gaps G and G′, as explained above, simultaneous downward movement of the stripper frame 19 and the pallet lifter frame 32 relative to the mold 11 will enable the stripper head 20 to strip the molded block from the mold without subjecting the block to crushing forces between the pallet 29 and the stripper head 20.

Following stripping of the block from the mold the drive mechanisms for the stripper frame 19 and the pallet lifter frame 32 return them to their initial positions. As the stripper head 20 moves upwardly out of the mold 11, the actuator 102 will be withdrawn from the sensor 101 of the proximity switch 100, thereby effecting adjustment of the valves 86 and 92 so as once again to inflate the bags 82. Withdrawal of the actuator 102 from the sensor 101 and consequent adjustment of the valve 86 will also effect deflation of the bags 84 so as to restore the parts to the positions illustrated in FIG. 1.

A particularly advantageous characteristic of the disclosed construction is that the proximity switch 100 enables the height of a molded block to be controlled very accurately from the top of the mold 11. That is, the parts of the switch 100 may be adjusted so that actuation of the switch occurs when the head 20 has moved a predetermined distance into the mold. The height of the block being molded, therefore, may be controlled by reference to the bottom of the mold, without having to consider the thickness of the pallet 28.

This disclosure is representative of a presently preferred embodiment of the invention, but is intended to be illustrative rather than definitive thereof. The invention is defined in the claims.

We claim:

1. In blocking making machinery having a vibratable mold for the reception of moldable material, a head member movable into said mold for compacting moldable material therein, a frame member movable relatively to said mold in a direction toward the latter, and connecting means interposed between said frame member and said head member and connecting said head member to said frame member for movement with and relative to the latter, the improvement comprising first and second yieldable cushioning means forming part of said connecting means and arranged in opposition to one another thereby to apply a yieldable, cushioned force in each of two opposite directions on said head member; and means for increasing or decreasing the force applied on said head member by a selected one of either of said cushioning means and substantially simultaneously decreasing or increasing, respectively, the force applied on said head member by the other of said cushioning means, each of said cushioning means being inflatable and deflatable, and means for inflating and deflating said cushioning means in timed relation to movement of said head member into said mold.

* * * * *